US006885346B2

(12) United States Patent
Ha et al.

(10) Patent No.: US 6,885,346 B2
(45) Date of Patent: Apr. 26, 2005

(54) BUILT-IN SINGLE BAND ANTENNA DEVICE AND OPERATING METHOD THEREOF IN MOBILE TERMINAL

(75) Inventors: Dong-In Ha, Seoul (KR); Wan-Jin Choi, Suwon-shi (KR); Dong-Hwan Kim, Seoul (KR); Jun-Kyu Kang, Seoul (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/956,691

(22) Filed: Sep. 20, 2001

(65) Prior Publication Data

US 2002/0033775 A1 Mar. 21, 2002

(30) Foreign Application Priority Data

Sep. 20, 2000 (KR) ..... 2000-55284

(51) Int. Cl.[7] ..... H01Q 1/24
(52) U.S. Cl. ..... 343/702; 455/575.7
(58) Field of Search ..... 343/702, 795, 343/846, 901; 455/575.7, 277.1

(56) References Cited

U.S. PATENT DOCUMENTS 4,571,595 A * 2/1986 Phillips et al. ..... 343/702
4,914,714 A * 4/1990 Tamura ..... 455/78
5,212,725 A * 5/1993 Yamamoto et al. ..... 343/702
5,245,350 A * 9/1993 Sroka ..... 343/702
5,818,392 A 10/1998 Oka et al.
5,926,139 A 7/1999 Korisch
5,936,583 A * 8/1999 Sekine et al. ..... 343/702
5,940,040 A 8/1999 Koyanagi et al.
6,046,703 A 4/2000 Wang et al.
6,097,339 A 8/2000 Filipovic et al.
6,239,765 B1 * 5/2001 Johnson et al. ..... 343/795
6,469,669 B1 * 10/2002 Tran ..... 343/702

FOREIGN PATENT DOCUMENTS

| | | |
|---|---|---|
| EP | 0 800 227 | 10/1997 |
| EP | 0 843 376 | 5/1998 |
| JP | 9-139621 | 5/1997 |
| JP | 11-186945 | 7/1999 |
| JP | 2000-216612 | 8/2000 |

* cited by examiner

*Primary Examiner*—Michael C. Wimer
(74) *Attorney, Agent, or Firm*—Dilworth & Barrese LLP

(57) ABSTRACT

There is provided a built-in single band antenna device and an operating method thereof in a mobile terminal. In the built-in antenna single band antenna device, a built-in single band antenna is formed into a conductive pattern on a board extended from the upper side of a main PCB. A whip antenna is connected to the built-in single band antenna, and contained in the mobile terminal when the whip antenna is retracted. A whip antenna driver extends or retracts the whip antenna. A duplexer separates an RF signal received from the built-in single band antenna from an RF signal to be transmitted to the built-in single band antenna. A controller processes the RF signals received at and transmitted from the duplexer and controls the whip antenna driver to extend the whip antenna in a speech state or upon a call attempt from a user.

23 Claims, 22 Drawing Sheets

BUILT-IN SINGLE BAND ANTENNA DEVICE AND OPERATING METHOD THEREOF IN MOBILE TERMINAL

PRIORITY

This application claims priority to an application entitled "Built-In Single Band Antenna Device and Operating Method Thereof in Mobile Terminal" filed in the Korean Industrial Property Office on Sep. 20, 2000 and assigned Serial No. 2000-55284, the contents of which are hereby incorporated by reference.

BACKGROUND OF THE INVENTION

1. Field of the Invention

The present invention relates generally to a mobile terminal, and in particular, to a built-in single band antenna device and an operating method thereof in a mobile terminal.

2. Description of the Related Art

In general, an antenna device in a mobile terminal includes a helical antenna protruding outside the terminal and a whip antenna. When the whip antenna is retracted into the interior of the terminal, the helical antenna operates and when the whip antenna is extended from the terminal, the whip antenna operates.

FIGS. 1A and 1B illustrate a conventional antenna for a mobile terminal. When a whip antenna 100 is contained inside a terminal 104 as shown in FIG. 1, an RF (Radio Frequency) signal is transmitted/received through a helical antenna 102 formed in an external protrusion portion 106. When the whip antenna 100 is pulled out as shown in FIG. 1B, the RF signal is transmitted/received through the whip antenna 100.

The protrusion of the helical antenna outside the terminal with the interworking structure of the conventional extendable whip antenna and the helical antenna impedes diverse designing of the terminal along the miniaturization trend and decreases portability. Besides, in case a user inadvertently drops the terminal from a certain height, the helical antenna is susceptible to breakage.

The protrusion of the helical antenna from one side of the terminal makes the configuration of terminal asymmetrical. The resulting asymmetry of a radiation pattern in a radio frequency band deteriorates directionality-related performance.

SUMMARY OF THE INVENTION

It is, therefore, an object of the present invention to provide a built-in single band antenna device and an operating method thereof in a mobile terminal to overcome the problems of design limitations, low reliability, and inconvenience to mobile communication encountered with a conventional mobile terminal.

To achieve the above object, there is provided a built-in single band antenna device and an operating method thereof in a mobile terminal. In the built-in antenna single band antenna device, a built-in single band antenna is formed into a conductive pattern on a board extended from the upper side of a main PCB. A whip antenna is connected to the built-in single band antenna, and contained in the mobile terminal when the whip antenna is retracted. A whip antenna driver extends or retracts the whip antenna. A duplexer separates an RF signal received from the built-in single band antenna from an RF signal to be transmitted to the built-in single band antenna. A controller processes the RF signals received at and transmitted from the duplexer and controls the whip antenna driver to extend the whip antenna in a speech state or upon a call attempt from a user.

The method of operating the built-in single band antenna and the whip antenna varies depending on whether the mobile terminal is in a speech state or an idle state. In an idle state, the built-in single band antenna is connected to a duplexer and in the speech state, the whip antenna is connected to the duplexer and extended.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENTS

Preferred embodiments of the present invention will be described hereinbelow with reference to the accompanying drawings. In the following description, well-known functions or constructions are not described in detail since they would obscure the invention in unnecessary detail.

Figure 1A:
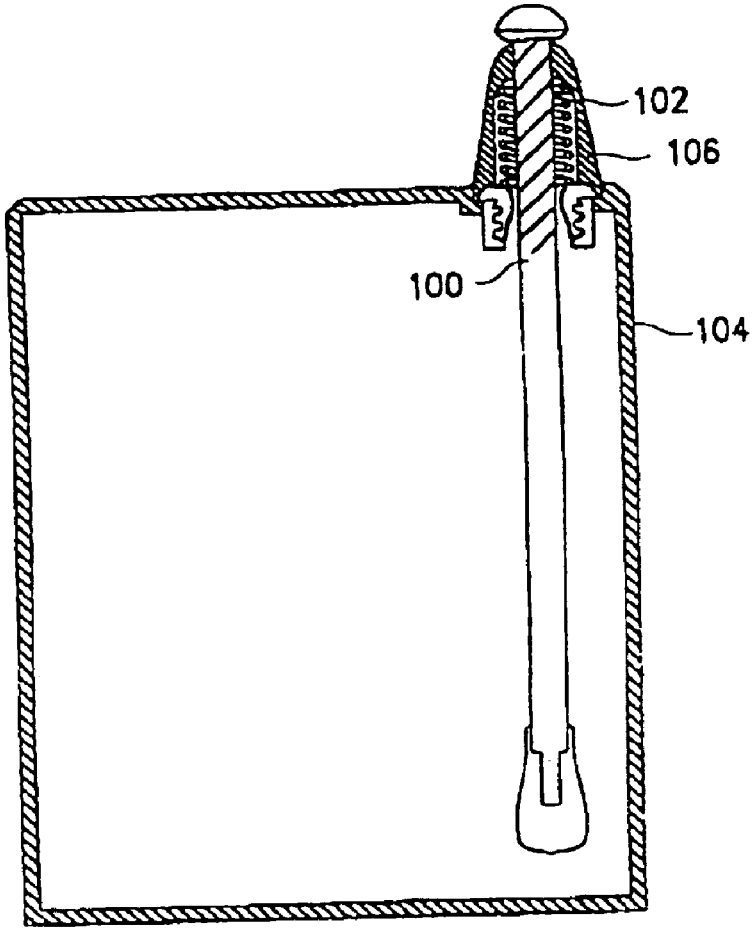
FIG.1A (PRIOR ART)
FIGS. 1A and 1B illustrate operational states of a conventional antenna for a mobile terminal.
Figure 1B:
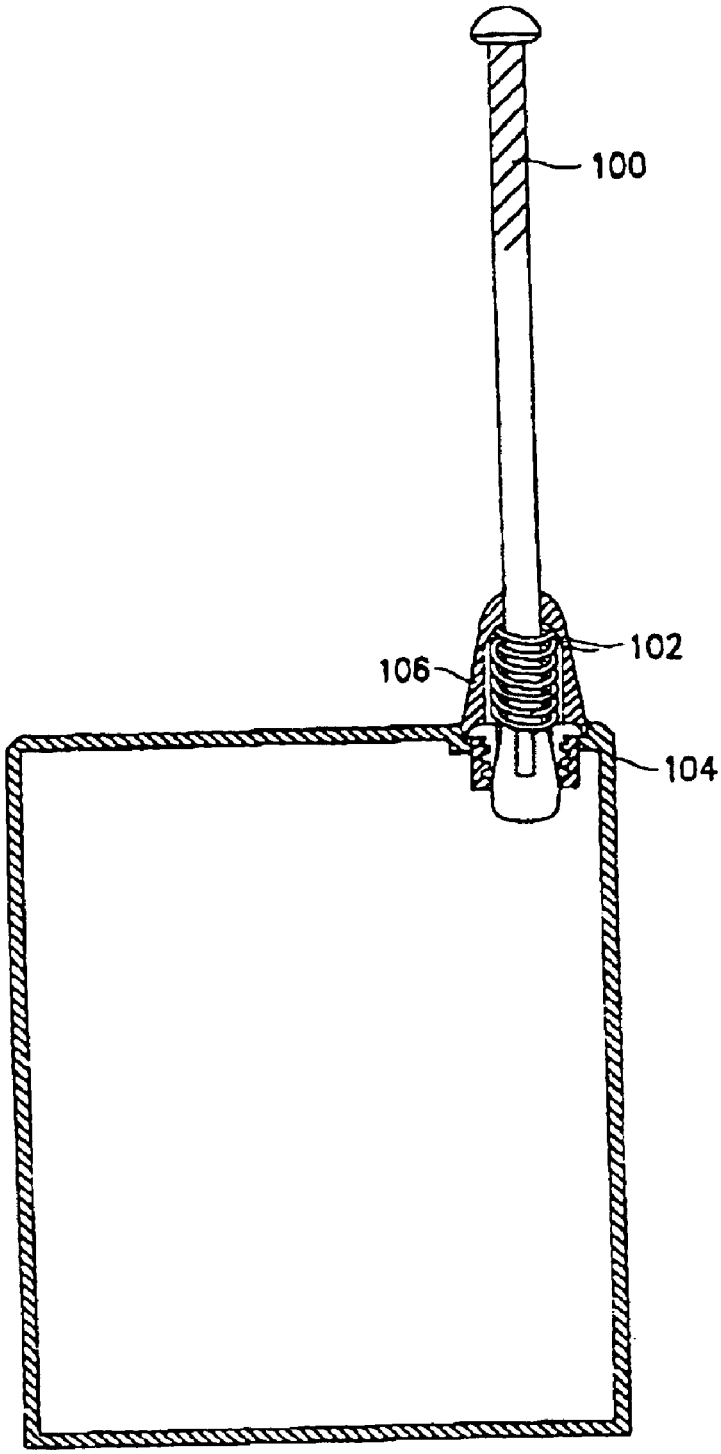
FIG.1B (PRIOR ART)
Figure 2:
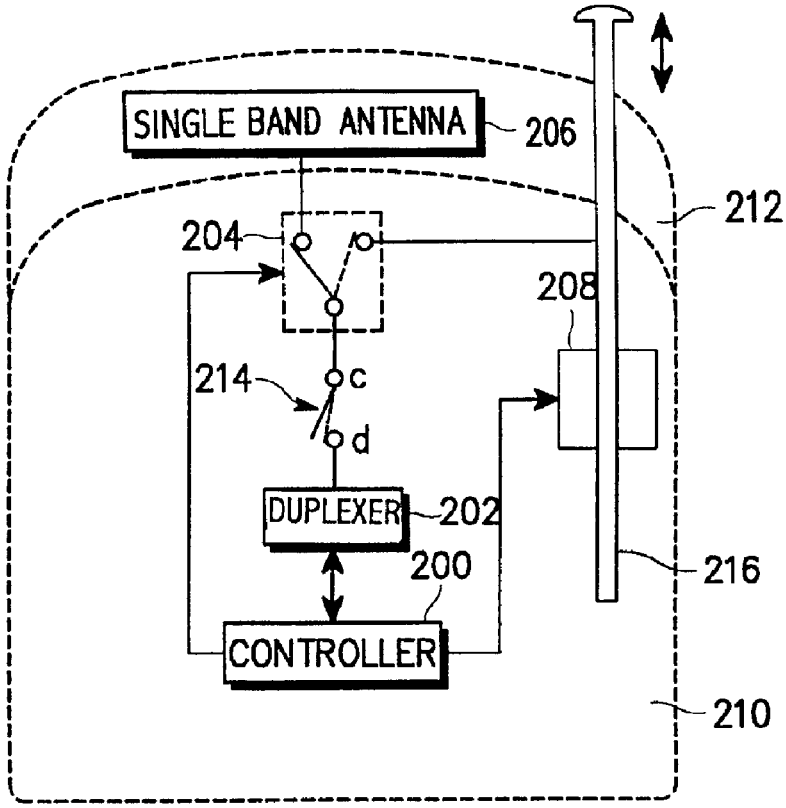
FIG. 2 is a block diagram of an embodiment of a built-in single band antenna device according to the present invention.

FIG. 2 is a block diagram of a built-in single band antenna device in a mobile terminal according to an embodiment of the present invention. Referring to FIG. 2, the built-in single band antenna device is comprised of a built-in single band antenna 206, an RF switch 204, a duplexer 202, a controller 200, a whip antenna driver 208, and a whip antenna 216.

The built-in single band antenna 206 is formed into a meander line pattern, a monopole type, or a dipole type on a board 212 extended from a main PCB (Printed Circuit Board) 210. The single band antenna pattern 206 can be modified when necessary. The antenna pattern 206 is designed so that its feeding point is at the center of the board 212. This prevents performance deterioration encountered in a mobile terminal with a conventional extendable antenna. As stated above, the problem is caused by an asymmetrical antenna radiation pattern in a high frequency band due to improper central power feeding. The whip antenna driver 208 moves the whip antenna 216 upward and downward by driving two driving rollers (not shown) at both sides of the whip antenna 216 under the control of the controller 200. The RF switch 204 switches the built-in single band antenna 206 and the whip antenna 216 selectively to the duplexer 202 under the control of the controller 200.

The controller 200 provides overall control to the mobile terminal. According to the embodiment of the present invention, the controller 200 selectively connects the built-in single band antenna 206 or the whip antenna 216 to the duplexer 202 by controlling the RF switch 204. During a call or when a user attempts a call by opening a flip for example, the controller 200 controls the whip antenna driver 208 to extend the whip antenna 216 outside the terminal. As shown in FIG. 2, the built-in single band antenna 206 is formed into a meander line pattern, a monopole antenna pattern, or a dipole antenna pattern on the board 212 and the whip antenna 216 is automatically pulled out and retracted in the embodiment of the present invention.

Figure 3:
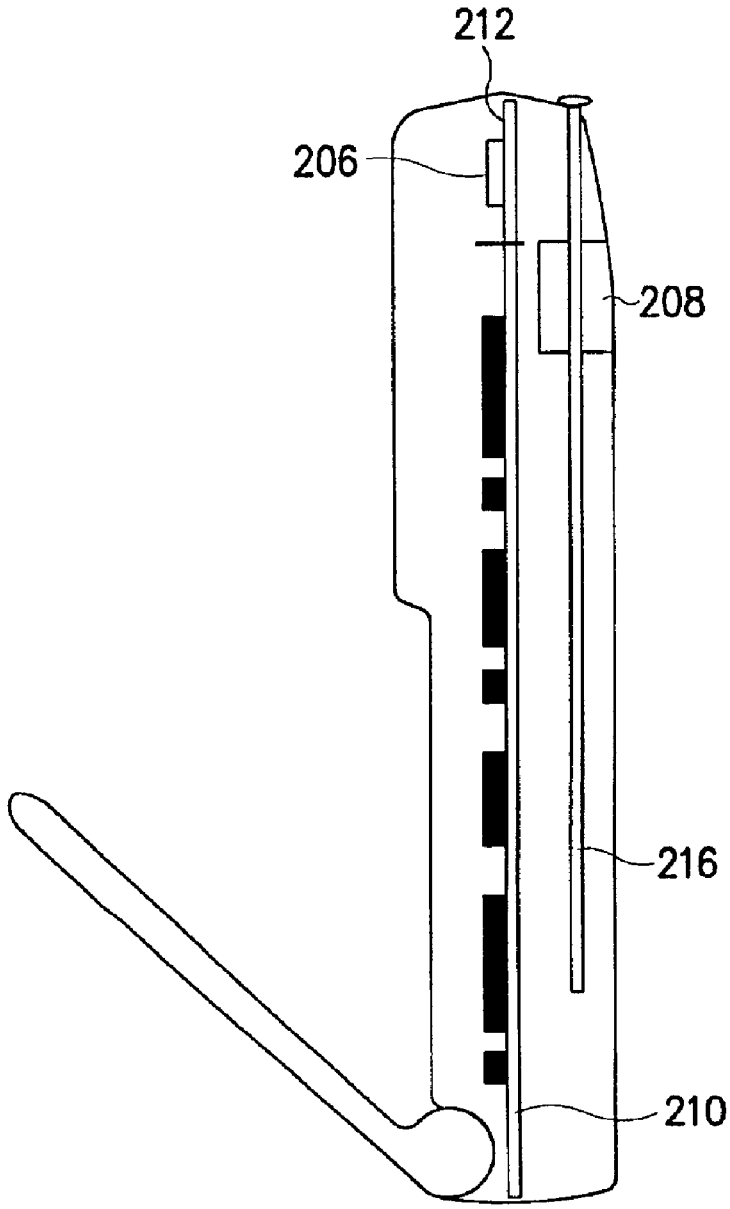
FIG. 3 is a side perspective view of the built-in single band antenna device shown in FIG. 2.

FIG. 3 is a side perspective view of a mobile terminal with the built-in single band antenna 206 according to the embodiment of the present invention. It is noted from FIG. 3 that the built-in single band antenna 206 is readily formed on the board 212 extended from the upper side of the main PCB 210. The whip antenna 216 is usually contained in the terminal. During a call or when a user attempts a call, the whip antenna 216 is extended by the whip antenna driver 208, thereby ensuring peak operating efficiency.

Referring back to FIG. 2, in operation, the RF switch 204 switches an RF signal transmitted/received to/from the duplexer 202 to the built-in single band antenna 206 or the whip antenna 216 under the control of the controller 200. The two antennas 206 and 216 operate independently. In an idle state or when an earphone is used, the controller 200 controls the RF switch 204 to switch the built-in single band antenna 206 to the duplexer 202. In a speech state, the controller 200 controls the RF switch 204 to switch the whip antenna 216 to the duplexer 202.

In the idle state, the controller 200 switches the RF switch 204 to the built-in single band antenna 206 and turns on a passive switch 214, connecting terminals c and d, 214, so that the built-in single band antenna 206 is connected to the duplexer 202. When a call is incoming in this state and the user answers the call by opening the flip or pressing a speech button, or when the user attempts to originate a call by opening the flip, the controller 200 controls the whip antenna driver 208 to extend the whip antenna 216 outside the terminal and controls the RF switch 204 to establish a signal path between the whip antenna 216 and the duplexer 202. Therefore, the connection between the duplexer 202 and the built-in single band antenna 206 is released and only the whip antenna 216 operates.

Figure 4:
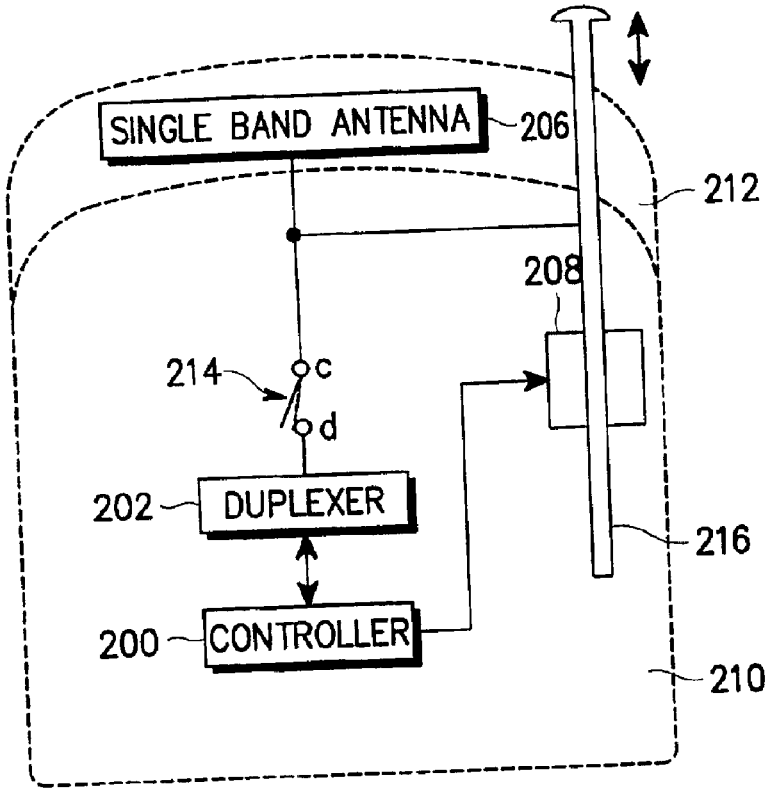
FIG. 4 is a block diagram of another embodiment of the built-in single band antenna device according to the present invention.

While the built-in single band antenna 206 and the whip antenna 216 are selectively connected to the duplexer 202 by the RF switch 204 in the embodiment of the present invention shown in FIG. 2, it can be contemplated that the built-in single band antenna 206 is connected to the whip antenna 216 all the time as shown in FIG. 4. Also in this case, when the user opens the flip to answer an incoming call or to originate a call, the controller 200 controls the whip antenna driver 208 to pull out the whip antenna 216 to ensure stable signal reception through the whip antenna 216.

In conclusion, the built-in single band antenna 206 operates while the whip antenna 216 is contained inside the terminal in an idle state, thereby ensuring terminal portability. On the other hand, the whip antenna 216 operates during a call, thereby improving RF signal reception characteristics and thus increasing communication quality.

Figure 5:
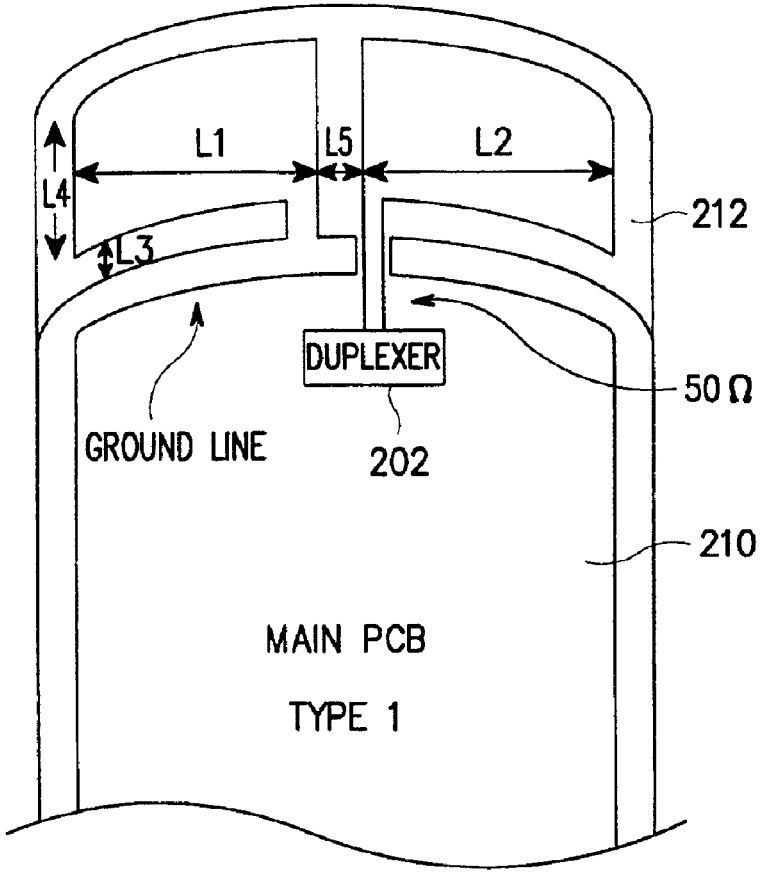
FIGS. 5, 6, and 7 illustrate embodiments of a pattern for a built-in single band antenna according to the present invention.
Figure 6:
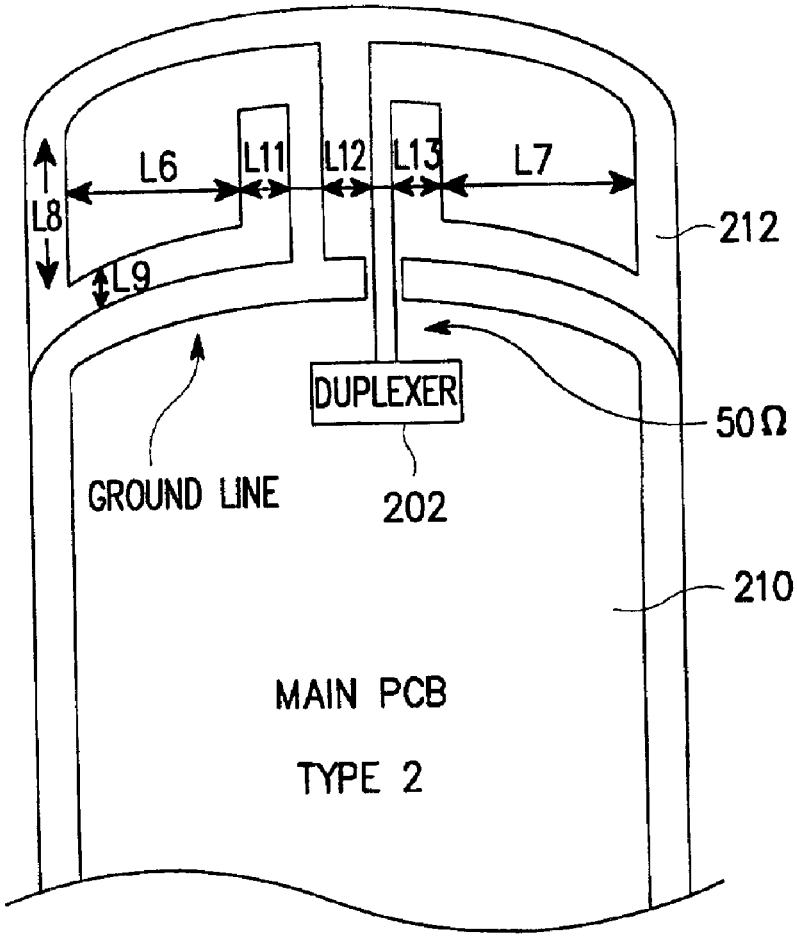
Figure 7:
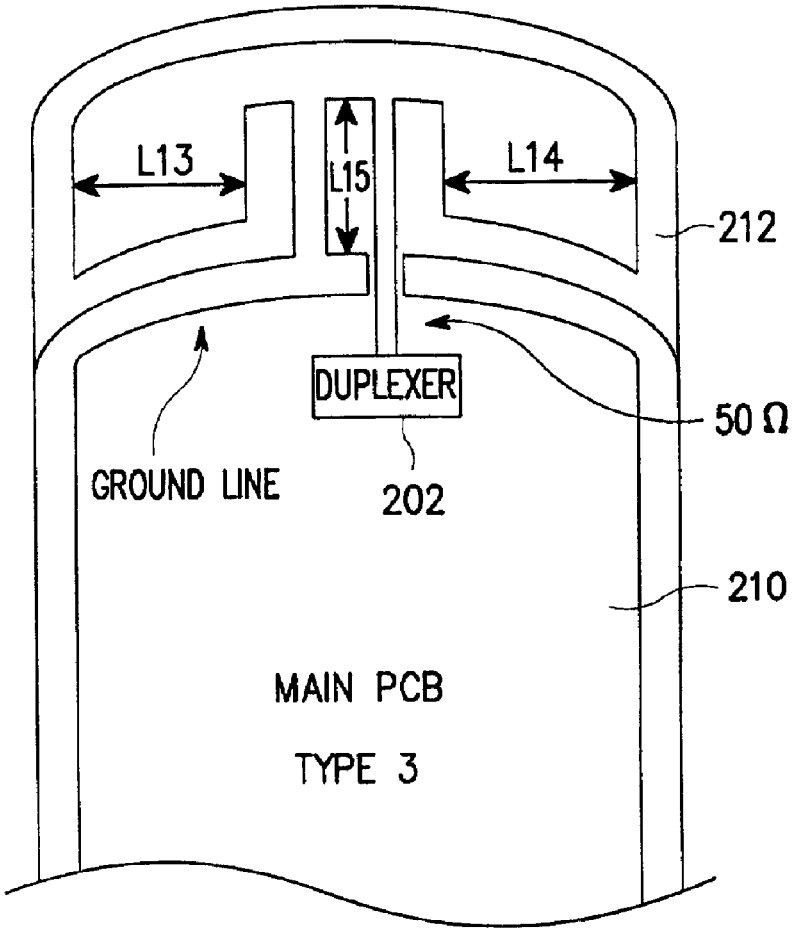

FIGS. 5, 6, and 7 are views illustrating embodiments of patterns of the built-in single band antenna according to the present invention. As stated above, the built-in single band antenna can be designed in diverse patterns. Referring to FIGS. 5, 6, and 7, each antenna pattern will be described.

Referring to FIG. 5, the built-in single band antenna 206 is formed into a dipole type. Since a resonant frequency varies in proportion to lengths L1 and L2, an optimal impedance matching is achieved by controlling lengths L3 and L5. To obtain a VSWR (Voltage Standing Wave Ratio) of 2 or below within a band, L3 should be 3 mm at least and L4 should be 4 mm or longer. A 50 Ω line is formed on the main PCB 210 for power feeding from the duplexer 202 to an antenna terminal.

Referring to FIG. 6, since L1 and L2 are too long to achieve miniaturization of the terminal in the antenna pattern shown in FIG. 5, a notch is formed along each of L1 and L2 in an antenna pattern shown in FIG. 6 so that L1 and L2 are decreased to L6 and L7, respectively while the resonant frequency of the antenna pattern shown in FIG. 5 is still maintained. Here, impedance matching is also controllable by adjusting lengths L9 and L11. Adjusting lengths L6 and L7 and the distance between L11 and L13 control the resonant frequency.

An antenna pattern shown in FIG. 7 is an inverted F type with an upper end thereof shorted, as compared to the antenna patterns shown in FIGS. 5 and 6. This antenna pattern can be designed to have an antenna terminal length shorter than those shown in FIGS. 5 and 6. As shown in FIG. 7, the antenna pattern is designed in a structure where a matching device is added to an inverted F type formed in a patch on the board 212, as observed from the center and right terminal of the antenna, and lengths L13 and L 14 are identical. The length of each terminal is adjusted in the same manner as in FIGS. 5 and 6, except that L15 is appropriately controlled to have no influence on impedance matching according to L13 & L14 and the structure of neighboring components because L15 significantly influences a VSWR value. Ground lines shown in FIGS. 5, 6, and 7 prevent interference between the antennas and RF circuits and ground the antennas. The ground lines should be brought into firm contact with shield walls of the devices.

Figure 8A:
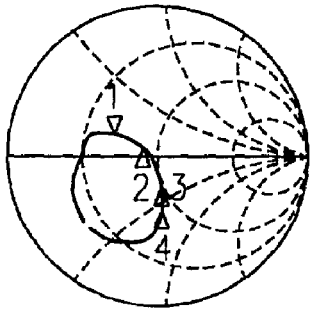
FIGS. 8A and 8B are graphs showing the impedance matching states of the built-in single band antenna according to the embodiment of the present invention and a conventional fixed helical antenna, respectively.
Figure 8A:
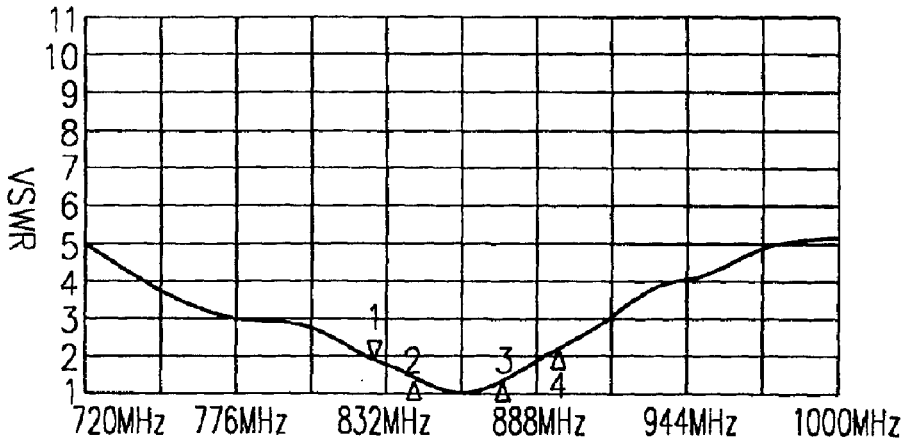
Figure 8B:
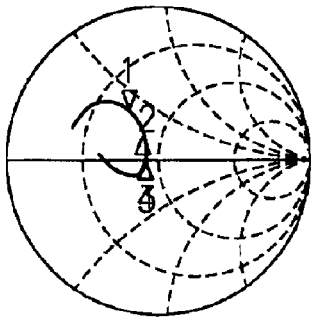
Figure 8B:
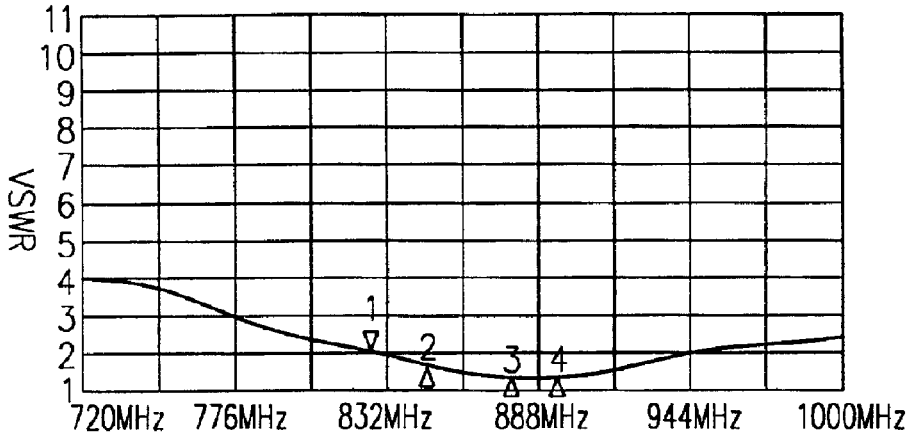

FIG. 8A is a graph showing the impedance matching state of a built-in antenna formed into the antenna pattern shown in FIG. 7 and FIG. 8B is a graph showing the impedance matching state of a typical fixed helical antenna. As noted from FIGS. 8A and 8B, the former shows a relatively narrow bandwidth but an excellent characteristic since a VSWR is 2 or below in a PCS band.

Figure 9A:
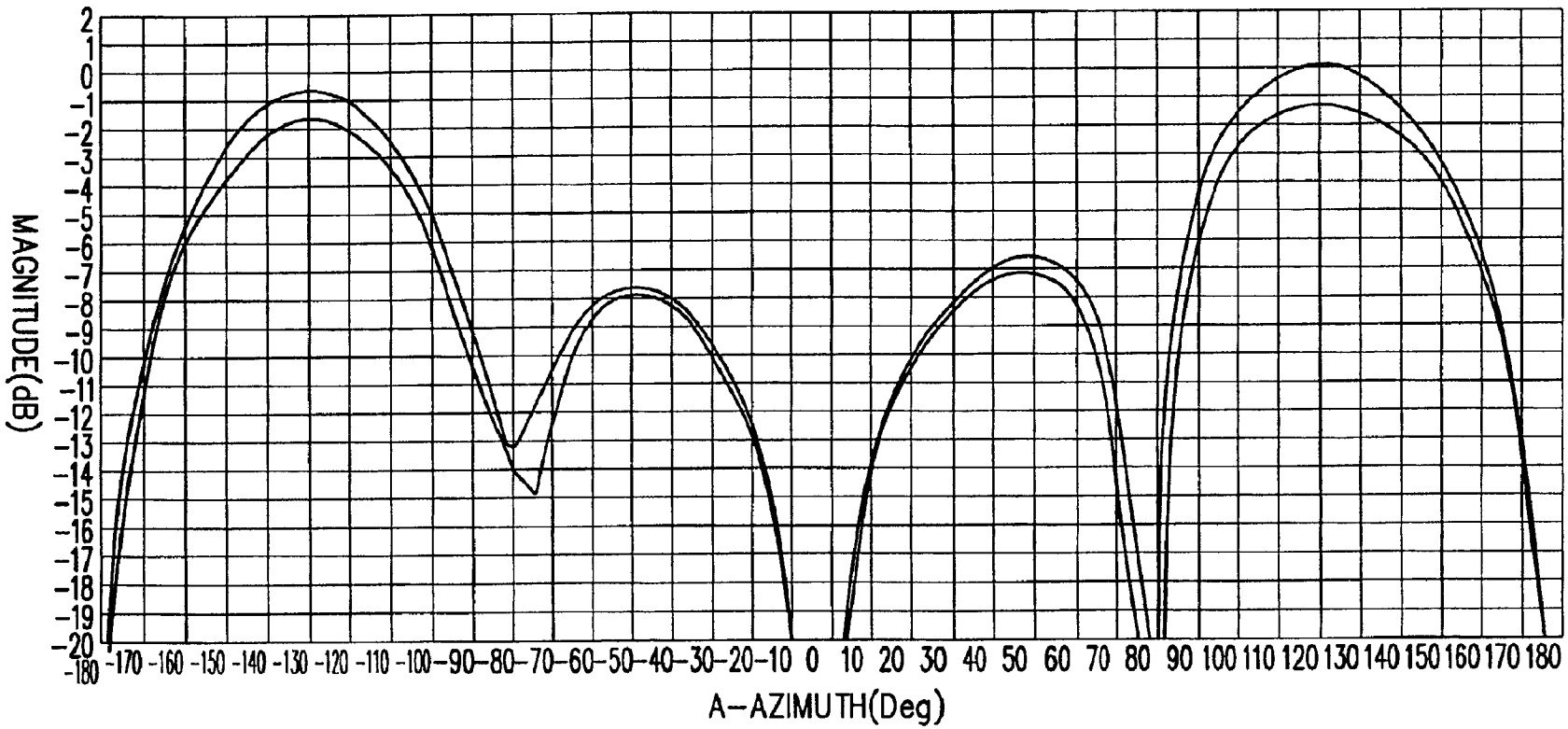
FIGS. 9A and 9B are graphs showing the anechoic chamber radiation pattern characteristics of the built-in single band antenna according to the embodiment of the present invention and the conventional fixed helical antenna, respectively.
Figure 9B:
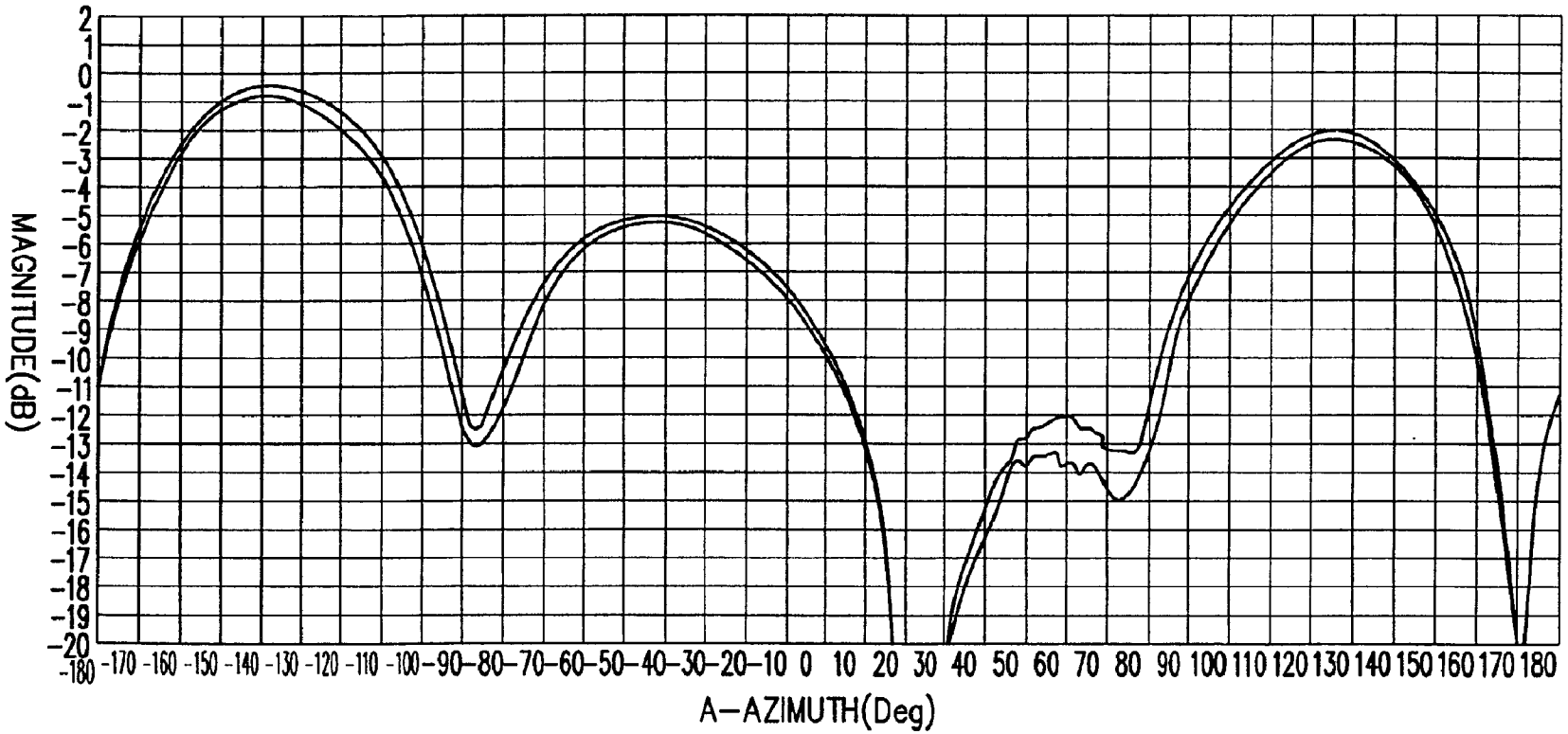

FIGS. 9A and 9B are graphs showing anechoic chamber radiation pattern characteristics of the built-in antenna with the antenna pattern of FIG. 7 and the fixed helical antenna. The anechoic chamber radiation pattern of the fixed helical antenna is asymmetrical, whereas that of the built-in antenna is symmetrical. Therefore, the built-in antenna has improved radiation characteristics.

The single band antenna pattern can be formed on a board extended at a right angle from the upper side of the main PCB instead of the board extended from the upper side of the main PCB in the mobile terminal.

Figure 10:
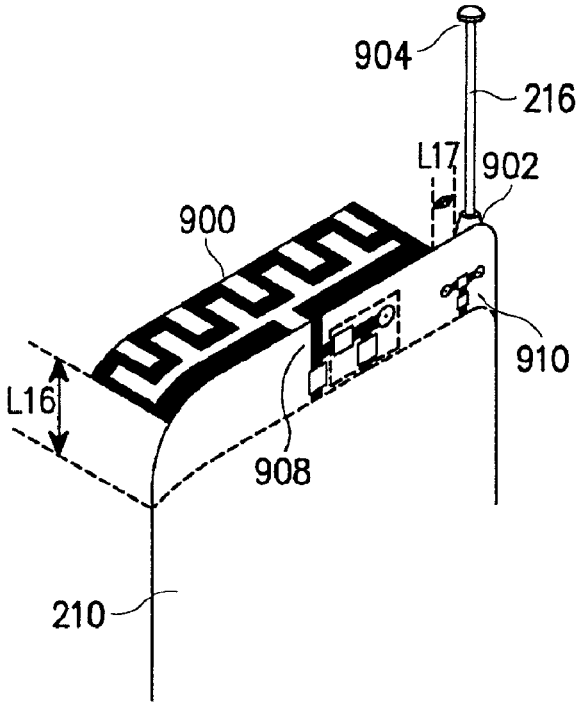
FIG. 10 illustrates a fourth embodiment of the built-in single band antenna pattern according to the present invention.

FIG. 10 illustrates another embodiment of the built-in single band antenna formed on a board extended at a right angle from the upper side of the main PCB according to the present invention. The built-in single band antenna 900 is formed into a meander line pattern in this embodiment by way of example. Nokia provides a built-in antenna spaced from a ground on the rear surface of a main PCB in a mobile terminal like model NOKIA 8210 or 3210. The position of the built-in antenna may have a serious influence on the radiation pattern of the antenna in the case that a metal or a human hand contacts the rear surface of the terminal. Consequently, communication quality is deteriorated.

On the other hand, since the built-in antenna is formed on the board extended from the upper side of the main PCB and thus positioned mechanically at the center of the terminal as shown in FIG. 2, the influence of contact with an external object on an antenna radiation pattern is minimized in the embodiment of the present invention. In addition, formation of the built-in antenna 900 on the board extended at the right angle from the upper side of the main PCB 210 enables miniaturization of the terminal.

Referring to FIG. 10, the built-in antenna 900 is spaced from a ground line of the main PCB 210 by a predetermined distance L16. As L16 increases, antenna performance is improved. However, it is preferable to maintain L16 to be 4 mm or greater at least. Every time L16 decreases by about 0.5 mm, the performance decreases by 10% or more. Therefore, L16 is set to 4.5 mm in the embodiment of the present invention.

The built-in antenna 900 and the whip antenna 216 are designed according to the CDMA band and power is fed from the center of the main PCB 210. The whip antenna 216 is supported in a metal portion 902 at the right side of the terminal. Because there is no need for a helical antenna as compared to a conventional extendable antenna, a knob 904 can be made short, thereby increasing portability. If the distance L17 between the built-in antenna 900 and the whip antenna 216 is too small, coupling may occur. The resulting change in impedance matching adversely affects the antenna radiation pattern. In accordance with the embodiment of the present invention, L 17 is set appropriately to prevent the change of the radiation pattern caused by coupling and matching circuits 908 and 910 are provided to the respective antennas 900 and 216 for separate impedance matching since optimal performance is not difficult to obtain with identical matching.

Figure 11:
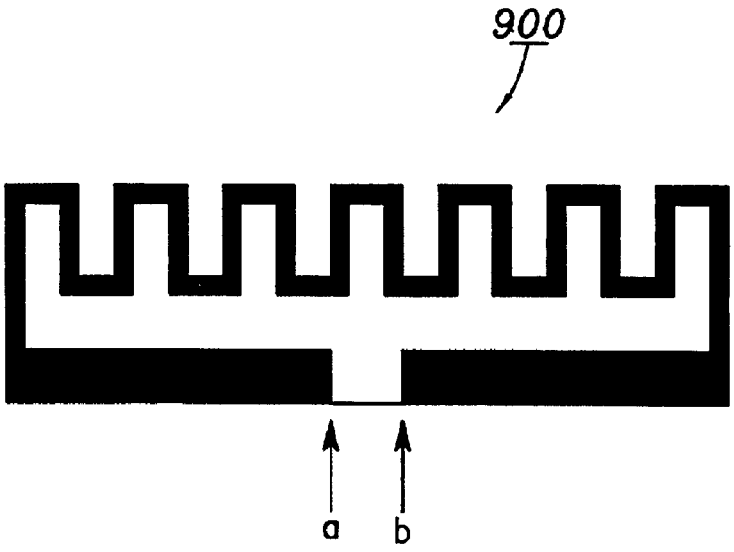
FIG. 11 illustrates the built-in single band antenna shown in FIG. 10 in detail.

FIG. 11 illustrates a pattern for the built-in antenna shown in FIG. 10. In the embodiment of the present invention, the built-in antenna is formed into a meander line pattern and either terminal a or terminal b can be used as a feeding point.

Figure 12:
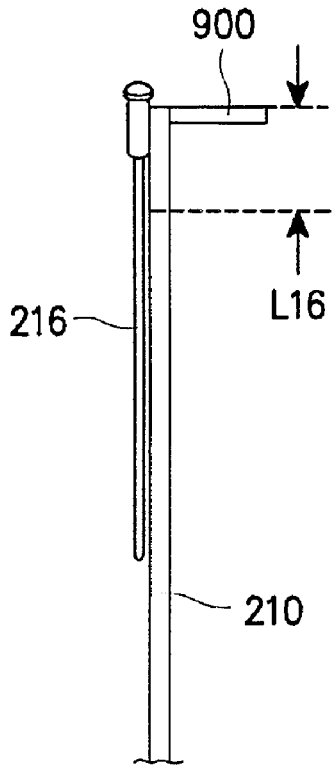
FIG. 12 is a side perspective view of another embodiment of the built-in single band antenna according to the present invention.

FIG. 12 is a side perspective view of the mobile terminal having the built-in single band antenna 900 on the board extended at the right angle from the upper side of the main PCB 210 as shown in FIG. 10. It is noted from FIG. 12 that the built-in antenna 900 can be easily formed on the board extended from the main PCB 210 and the whip antenna 216 can be entirely retracted within the terminal, increasing portability.

Figure 13A:
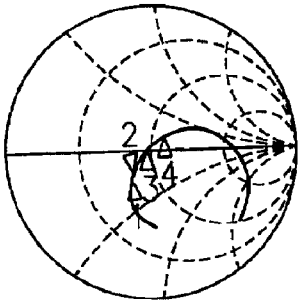
FIGS. 13A to 13D are graphs showing the impedance matching states of the built-in single band antenna shown in FIG. 12 and a conventional extendable antenna.
Figure 13A:
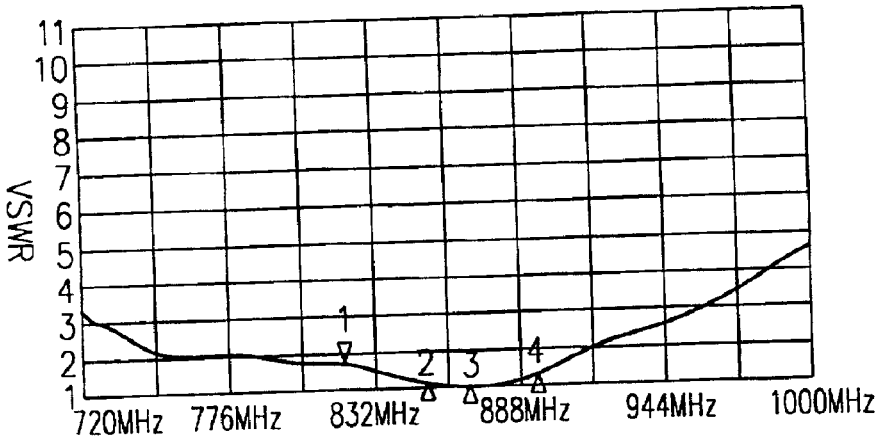
Figure 13B:
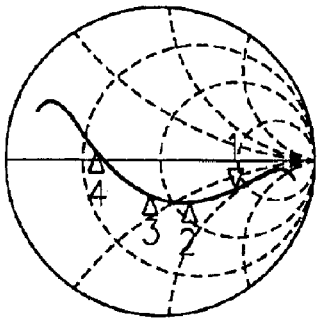
Figure 13B:
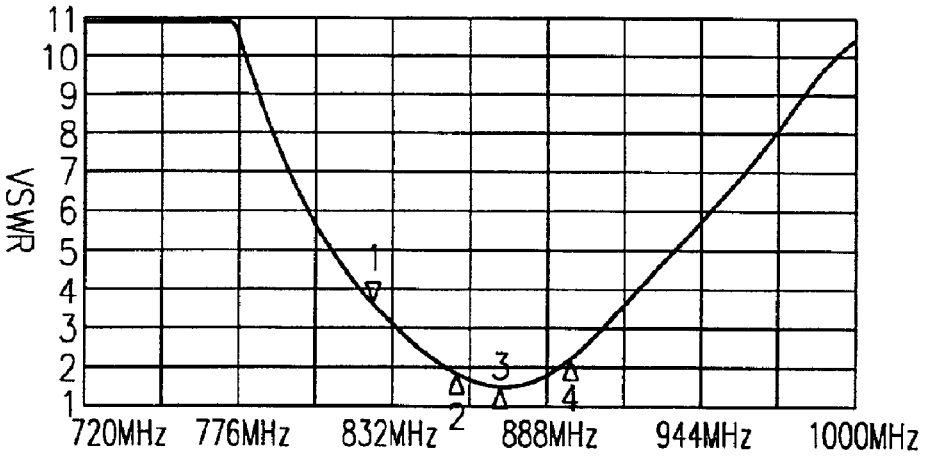
Figure 13C:
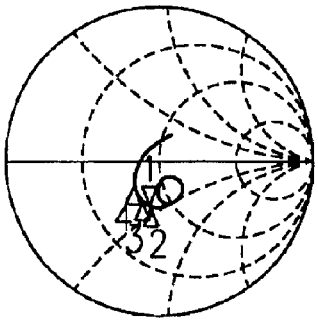
Figure 13C:
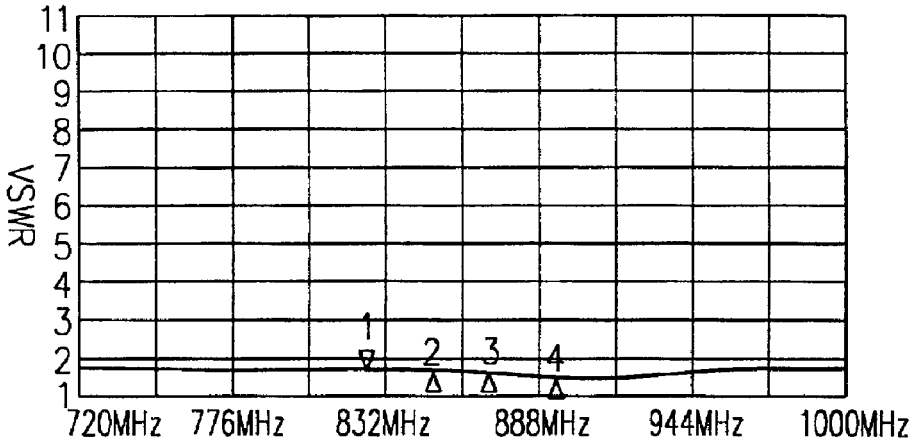
Figure 13D:
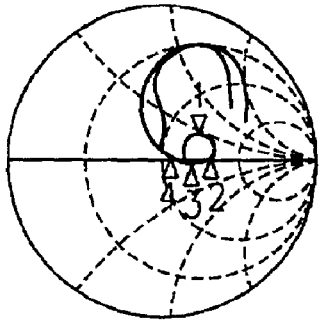
Figure 13D:
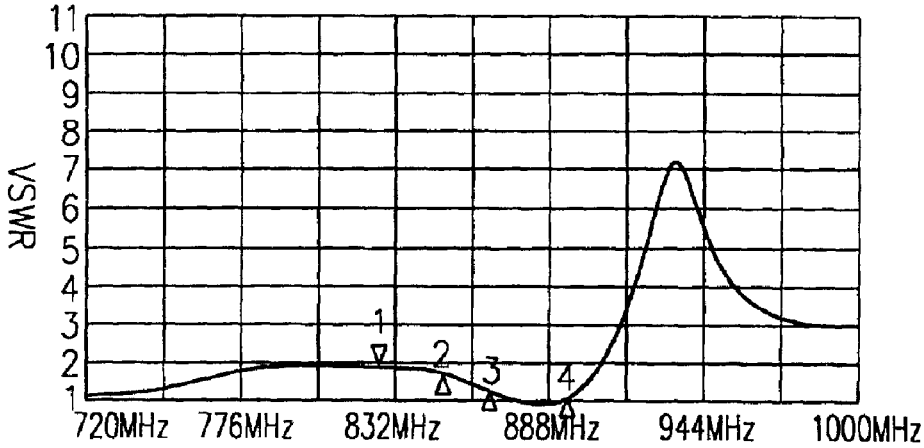

FIGS. 13A and 13B are graphs respectively showing the impedance matching states of a mobile terminal with the conventional extendable antenna and the mobile terminal with the built-in single band antenna 900 when their whip antennas are retracted. Due to a narrow bandwidth, the built-in single band antenna 900 shows the impedance matching state shown in FIG. 13B. FIGS. 13C and 13D are graphs respectively showing the impedance matching states of the mobile terminal with the conventional extendable antenna and the mobile terminal with the built-in single band antenna 900 when their whip antennas are extended. As shown in FIG. 13D, impedance matching imbalance is observed due to coupling between the whip antenna 216 and the built-in antenna 900. This can be prevented by increasing L17 and thus preventing coupling between the whip antenna 216 and the metal portion 902.

Figure 14A:
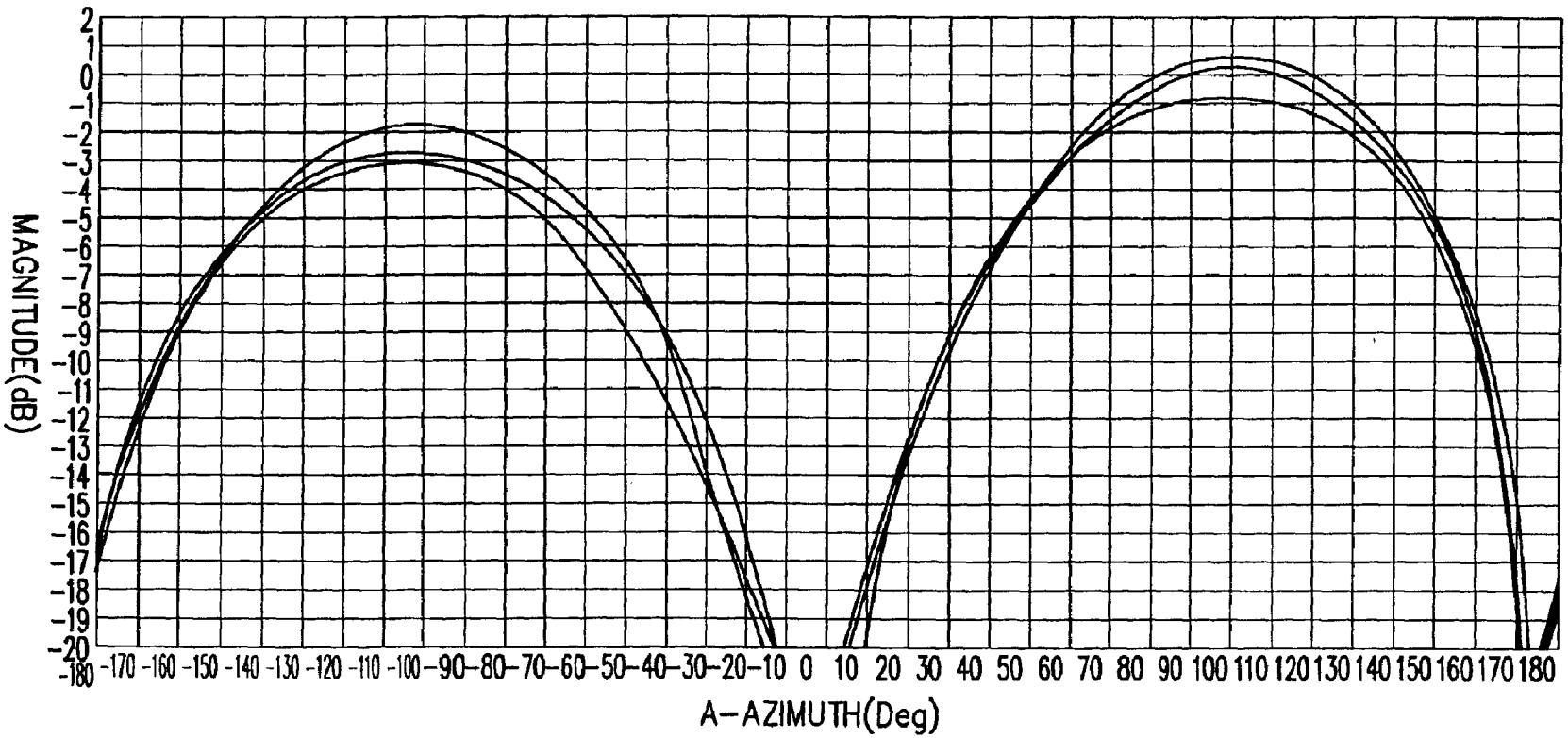
FIGS. 14A and 14B are graphs showing the radiation patterns of the built-in single band antenna shown in FIG. 12 and the conventional extendable antenna when their whip antennas are retracted, respectively.
Figure 14B:
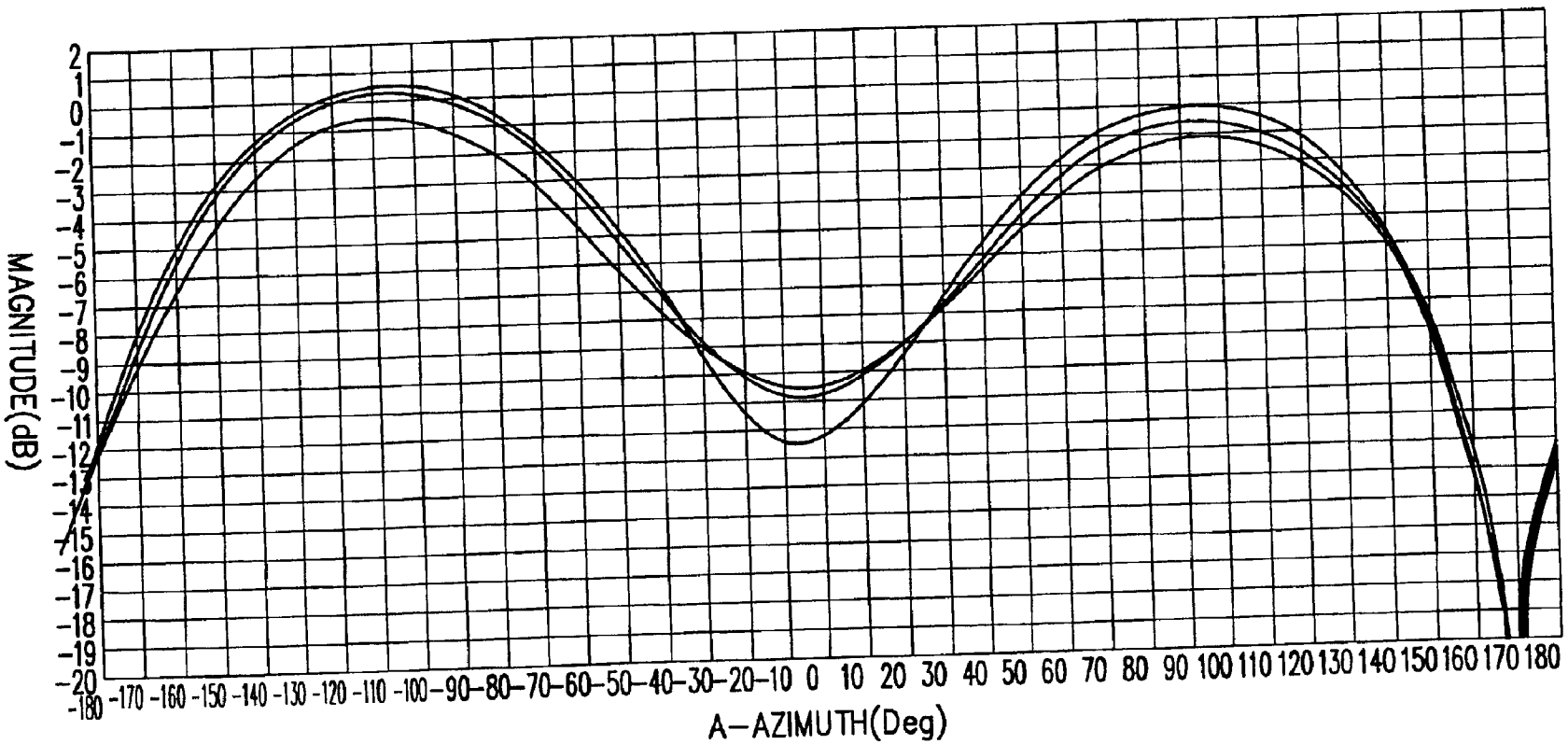

FIGS. 14A and 14B are graphs respectively showing the antenna radiation patterns of the mobile terminal with the conventional extendable antenna and the mobile terminal with the built-in single band antenna 900 when their whip antennas are retracted.

Figure 15A:
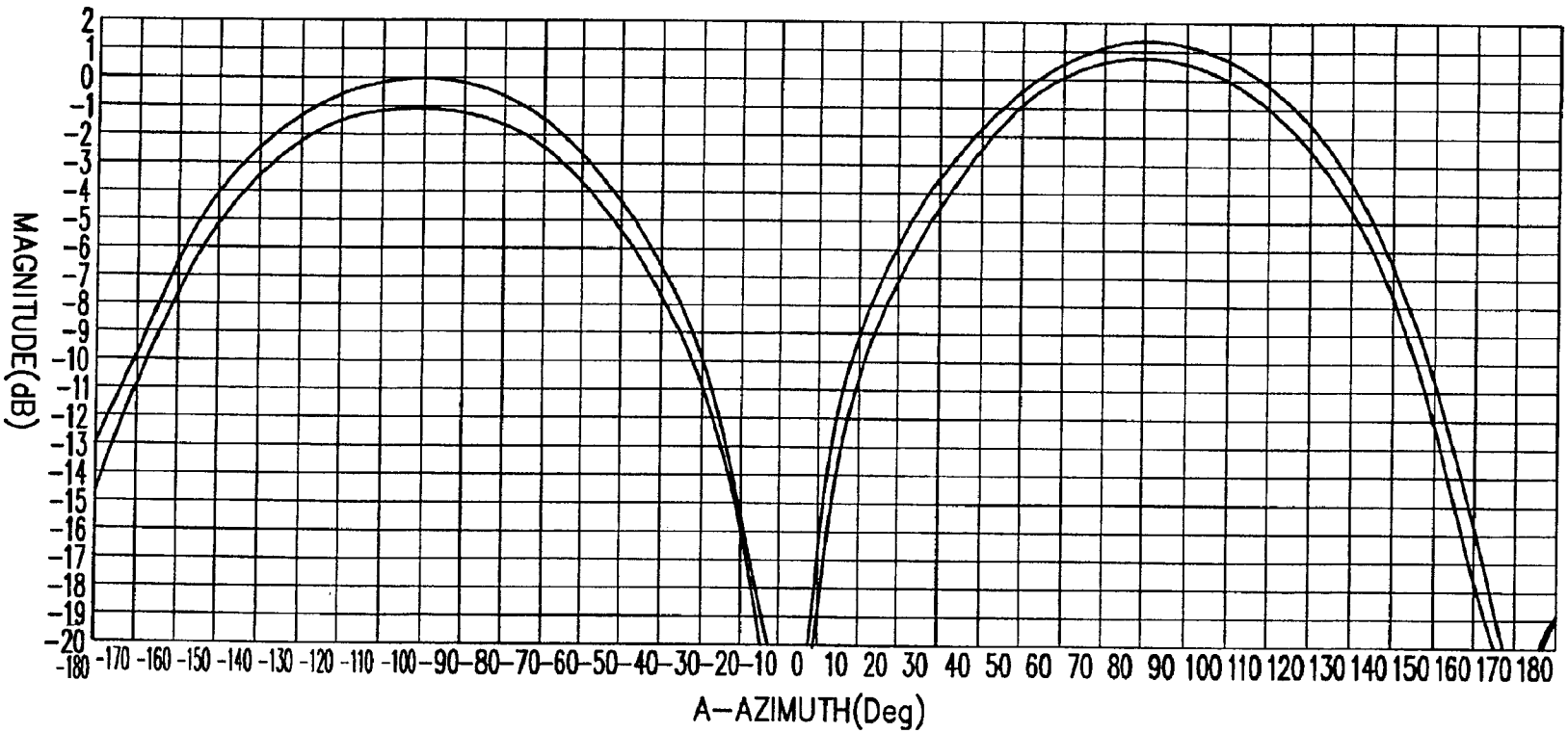
FIGS. 15A and 15B are graphs showing the antenna radiation pattern of a mobile terminal having the conventional extendable antenna and the antenna radiation pattern of a mobile terminal having the built-in single band antenna shown in FIG. 12 when their whip antennas are pulled out, respectively.
Figure 15B:
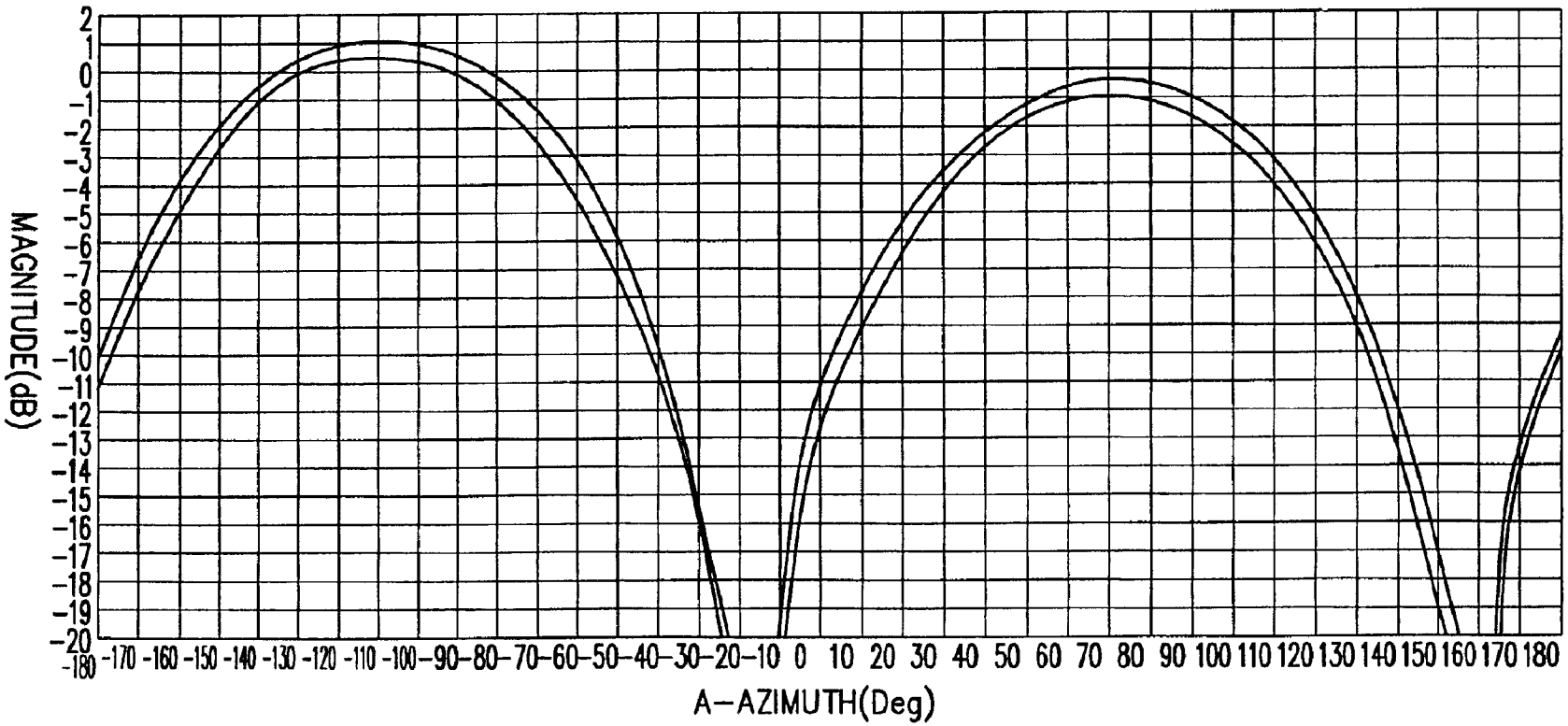

FIGS. 15A and 15B are graphs respectively showing the antenna radiation patterns of the mobile terminal with the conventional extendable antenna and the mobile terminal with the built-in single band antenna 900 when their whip antennas are extended. As noted from FIGS. 14A to 15B, the radiation patterns of the built-in antenna 900 are similar to those of the conventional extendable antenna.

In accordance with the present invention as described above, formation of a built-in antenna on a board extended from the upper side of a main PCB in a mobile terminal reduces distortion in an antenna radiation pattern, increases the portability of the mobile terminal, and achieves communication quality at the same level as that of the conventional extendable antenna.

While the built-in antenna is connected to the duplexer in an idle state if a user answers an incoming call by opening the flip or pressing a speech button or originates a call by opening the flip, the whip antenna is connected to the duplexer in the embodiments of the present invention, this is optional to the user. That is, though the antenna device of the present invention is basically configured such that the whip antenna is used in a speech state, a call can be conducted using the built-in single band antenna without antenna switching if the user does not want to use the whip antenna. Also, automated retraction of a whip antenna can be set differently depending on the characteristics of a mobile terminal.

Therefore, it will be understood by those skilled in the art that various changes in form and details may be made therein without departing from the spirit and scope of the invention as defined by the appended claims.

What is claimed is:

1. A built-in single band antenna device in a mobile terminal, comprising:

a built-in single band antenna formed into a conductive pattern on a board extending from the upper side of a main printed circuit board (PCB);

a duplexer for separating a radio frequency (RE) signal received from the built-in single band antenna from a second RE signal transmitted to the built-in single band antenna; and a controller for processing the RF signal directed from the built-in single band antenna to the duplexer, the controller detecting whether the mobile terminal is in one of an idle state and a call state, connecting the built-in single band antenna to receive and transmit RF signals if the mobile terminal is in the idle state, and disconnecting the built-in single band antenna if the mobile terminal is in the call state;

wherein the call state is a state in which the mobile terminal is one of being actively engaged in a call and attempting to connect a call, and the idle state is a state in which the mobile terminal is not engaged in a call.

2. The built-in single band antenna device of claim 1, wherein the built-in single band antenna is formed into a central feeding meander line pattern on the board extending from the upper side of the main PCB.

3. The built-in single band antenna device of claim 1, wherein the built-in single band antenna is formed into a central feeding dipole on the board extending from the upper side of the main PCB.

4. The built-in single band antenna device of claim 1, wherein the built-in single band antenna is formed into an inverted F type on the board extending from the upper side of the main PCB.

5. The built-in single band antenna device of claim 1, wherein the built-in single band antenna is formed into a meander line pattern on the board extending from the upper side of the main PCB.

6. The built-in single band antenna device of claim 1, wherein the built-in single band antenna transmits and receives a signal in a high frequency band and a signal in a low frequency band.

7. A built-in single band antenna device in a mobile terminal, comprising:

a built-in single band antenna formed into a conductive pattern on a board extending at a right angle from the upper side of a main Printed Circuit Board (PCB);

a duplexer for separating a Radio Frequency (RF) signal received from the built-in single band antenna from a second RE signal transmitted to the built-in single band antenna; and a controller for processing the RF signal directed from the built-in single band antenna to the duplexer, the controller detecting whether the mobile terminal is in one of an idle state and a call state, connecting the built-in single band antenna to receive and transmit RE signals if the mobile terminal is in the idle state, and disconnecting the built-in single band antenna if the mobile terminal is in the a call state;

wherein the call state is a state in which the mobile terminal is one of being actively engaged in a call and attempting to connect a call, and the idle state is a state in which the mobile terminal is not engaged in a call.

8. The built-in single band antenna device of claim 7, wherein the built-in single band antenna is spaced from a ground line of the main PCB by at least 4 mm or greater.

9. The built-in single band antenna device of claim 7, wherein the built-in single band antenna is formed into a meander line pattern having a feeding point at the center thereof.

10. The built-in single band antenna device of claim 7, wherein the built-in single band antenna is formed into a central feeding dipole type on the board extending at the right angle from the upper side of the main PCB.

11. The built-in single band antenna device of claim 7, wherein the built-in single band antenna is formed into an inverted F type on the board extending at the right angle from the upper side of the main PCB.

12. The built-in single band antenna device of claim 7, wherein the built-in single band antenna is formed into a meander line pattern on the board extending at the right angle from the upper side of the main PCB.

13. The built-in single band antenna device of claim 7, wherein the built-in single band antenna transmits and receives a signal in a high frequency band and a signal in a low frequency band.

14. A built-in single band antenna device in a mobile terminal, comprising:

a built-in single band antenna formed into a conductive pattern on a board extending from the upper side of a main Printed Circuit Board (PCB);

a whip antenna contained in the interior of the mobile terminal when the whip antenna is retracted;

a duplexer for separating a Radio Frequency (RF) signal received from the built-in single band antenna from a second RF signal transmitted to the built-in single band antenna;

an RF switch for selectively switching the built-in single band antenna and the whip antenna to the duplexer; and a controller for controlling the RF switch to switch the built-in single band antenna or the whip antenna to the duplexer, the controller detecting whether the mobile terminal is in one of an idle state and a call state, controlling the RF switch to switch the built-in single antenna to the duplexer if the mobile terminal is in the idle state and to switch the whip antenna to the duplexer if the mobile terminal is in the the call state;

wherein the call state is a state in which the mobile terminal is one of being actively engaged in a call and attempting to connect a call, and the idle state is a state in which the mobile terminal is not engaged in a call.

15. The built-in single band antenna device of claim 14, wherein the duplexer separates the RF signal received from the built-in single band antenna from the whip antenna.

16. The built-in single band antenna device of claim 14, wherein the controller controls the RF switch to switch the built-in single antenna to the duplexer in an idle state and to switch the whip antenna to the duplexer in a speech state or upon a call attempt from a user.

17. The built-in single band antenna device of claim 14, wherein the controller controls a whip antenna driver to extend the whip antenna outside the mobile terminal in the speech state or upon the call attempt from the user.

18. The built-in single band antenna device of claim 17, wherein the whip antenna driver comprises:

at least one roller in contact with the whip antenna; and a driving motor for rotating the roller to extend or retract the whip antenna.

19. A built-in single band antenna device in a mobile terminal, comprising:

a built-in single band antenna formed into a conductive pattern on a board extending from the upper side of a main Printed Circuit Board (PCB);

a whip antenna connected to the built-in single band antenna, and contained in the mobile terminal when the whip antenna is retracted;

a duplexer for separating a Radio Frequency (RF) signal received from the built-in single band antenna and the whip antenna from a second RF signal transmitted to the built-in single band antenna and the whip antenna; and a controller for processing the RE signals received at and transmitted from the duplexer, detecting whether the mobile terminal is in a speech state or a call attempt from a user, and controlling a whip antenna driver to extend the whip antenna in the speech state or upon the call attempt from the user;

wherein the speech state is a state in which the mobile terminal is actively engaged in a call.

20. The built-in single band antenna device of claim 19, wherein the whip antenna driver maintains the whip antenna in a retracted state when the user utilizes an earphone.

21. A method of operating a built-in single band antenna and a whip antenna in a mobile terminal, comprising the steps of:

checking whether the mobile terminal is in one of a speech state and an idle state;

connecting the built-in single band antenna to a duplexer in the idle state; and connecting the whip antenna to the duplexer and extending the whip antenna in the speech state;

wherein the speech state is a state in which the mobile terminal is actively engaged in a call, and the idle state is a state in which the mobile terminal is not enagaged in a call.

22. The method of claim 21, further comprising the step of connecting the whip antenna to the duplexer when a user attempts to originate a call.

23. The method of claim 21, further comprising the step of checking whether a user is utilizing an earphone and, if the earphone is found to be in use, retracting the whip antenna.

* * * * *